United States Patent [19]

Dahlhaus et al.

[11] 4,339,077

[45] Jul. 13, 1982

[54] RAIL MOUNTING SYSTEM

[75] Inventors: Peter Dahlhaus, Radevormwald; Horst E. Steinfeld, Schwerte; Wilhelm Striepeke, Bochum-Langendreer, all of Fed. Rep. of Germany

[73] Assignee: Estel Hoesch Werke AG, Dortmund, Fed. Rep. of Germany

[21] Appl. No.: 193,173

[22] Filed: Oct. 2, 1980

[30] Foreign Application Priority Data

Nov. 6, 1979 [DE] Fed. Rep. of Germany ..... 2944725

[51] Int. Cl.[3] ..... E01B 9/30

[52] U.S. Cl. ..... 238/349; 238/338

[58] Field of Search ..... 238/310, 338, 349, 366, 238/371, 374, 343, 345, 348, 351, 355, 375

[56] References Cited

U.S. PATENT DOCUMENTS

| | | | |
|---|---|---|---|
| 1,083,181 | 12/1913 | Bates | 238/374 X |
| 3,147,921 | 9/1964 | Delcroix | 238/310 |

FOREIGN PATENT DOCUMENTS

| | | | |
|---|---|---|---|
| 1106788 | 4/1963 | Fed. Rep. of Germany . | |
| 52-1805 | 1/1977 | Japan | 238/374 |
| 155123 | 7/1956 | Sweden | 238/349 |
| 18789 | of 1915 | United Kingdom | 238/374 |
| 885334 | 12/1961 | United Kingdom | 238/349 |
| 1010878 | 11/1965 | United Kingdom | 238/349 |
| 2045320 | 10/1980 | United Kingdom | 238/349 |

*Primary Examiner*—Randolph A. Reese
*Attorney, Agent, or Firm*—Max Fogiel

[57] ABSTRACT

A rail mounting system for mounting ties on concrete rails includes one or more concrete rails each having an upper surface from which a passage extends inwardly and downwardly and diverges in downward direction. For each passage there is provided a rail mounting member having a shaft provided at its upper end with a springy portion and at its lower end with a claw which extends laterally of and is inclined to the shaft. The upper open end of the passage has an outline corresponding to a vertical projection of the claw onto the surface of the tie.

8 Claims, 4 Drawing Figures

RAIL MOUNTING SYSTEM

BACKGROUND OF THE INVENTION

This invention relates to a rail mounting system for use in connection with rail beds.

Rails for railroads and similar applications are laid on top of transversely extending ties to which they are fastened. Originally, all ties were of wood and the rails secured to them by spikes driven through openings in the rail base. More and more, however, the use of concrete ties is preferred; various ways of securing the rails to these have been proposed and it is currently the accepted state of the art that a yieldable connection is the most advantageous one for various reasons.

Such a connection is disclosed in British Patent No. 2,045,320. A problem here is that the connection cannot laterally guide the rail and that lateral forces must be transmitted by a guide plate. Also, the concrete rail must be provided with special reinforcements beneath which a claw of the connecting device can engage, and the application of tension is difficult.

A spring nail for wooden ties is known from German Patent No. 1,106,788. This permits simple mounting and dismounting, as well as being able to withstand lateral forces transmitted from the rail. However, this nail is not usable with a concrete tie, because the low coefficient of friction between the steel of the nail and the concrete of the tie is insufficient to produce the required hold-down force. This cannot be remedied by deforming the shaft of the nail within the concrete tie, because to do so would result in cracking of the tie parallel to its reinforcements.

SUMMARY OF THE INVENTION

Accordingly, it is an object of the present invention to provide further improvements over the prior art.

A more particular object of the invention is to provide a rail mounting system for vehicle rails which provides for a yieldable or springy connection of the rails to concrete ties.

Another object of the invention is to provide such a system which permits a simple mounting and demounting by pushing or pulling in vertical direction.

A concomitant object is to provide a rail mounting system of the type in question which affords good lateral rail engagement.

Still a further object is to provide a rail mounting system of the type under discussion which is accommodated to the particular material characteristics of concrete and which is constructed as a simple element.

In keeping with these objects, and to others which will become apparent hereafter, one aspect of the invention resides in a mounting system for vehicle rails which, briefly stated, comprises a rail mounting member having an elongated shaft, a springy rail engaging portion projecting from an upper end of the shaft and a claw projecting to one side of the shaft at the lower end of the same. The shaft and the claw enter into a recess formed in a cooperating concrete tie and this recess has at the upper surface of the tie an area corresponding to a vertical projection of the claw onto the surface, and diverges in its cross-section from the upper opening towards the lower end of the recess in a direction transversely to the elongation of the claw.

A particularly advantageous embodiment is obtained if the rail mounting member has two shafts which are connected by a transverse portion and which are each provided with a claw, the claws being located in a plane passing through the longitudinal center lines of both of the shafts. It is also advantageous if the springy portion directly engages the base of the rail, but it is certainly possible for a mounting plate or the like to be interposed between the rail and the upper surface of the concrete tie. Finally, it is to be understood that it is an advantage if the claw and the shaft include with one another an angle of between substantially 95°–140°.

The present invention has a variety of advantages as compared to the previous state of the art, including the fact that it provides for a simple structural element which permits a spring (i.e. yieldable) connection of the rail to concrete ties, which can be used with the concrete ties without requiring the ties to be provided with additional reinforcements. Another advantage is that due to the construction of the claw additional pressures can be introduced into the concrete tie and operation, due to the wedge action of the claw, so that the mounting system according to the invention makes advantageous use of the fact that concrete is better able to withstand pressure forces than tensile forces.

The invention will hereafter be described with reference to an exemplary embodiment which is illustrated in the appended drawing. However, it should be understood that this is for purposes of explanation only and is not to be considered limiting, the boundaries of the desired protection being exclusively defined by the appended claims.

DESCRIPTION OF THE PREFERRED EMBODIMENTS

Figure 1:
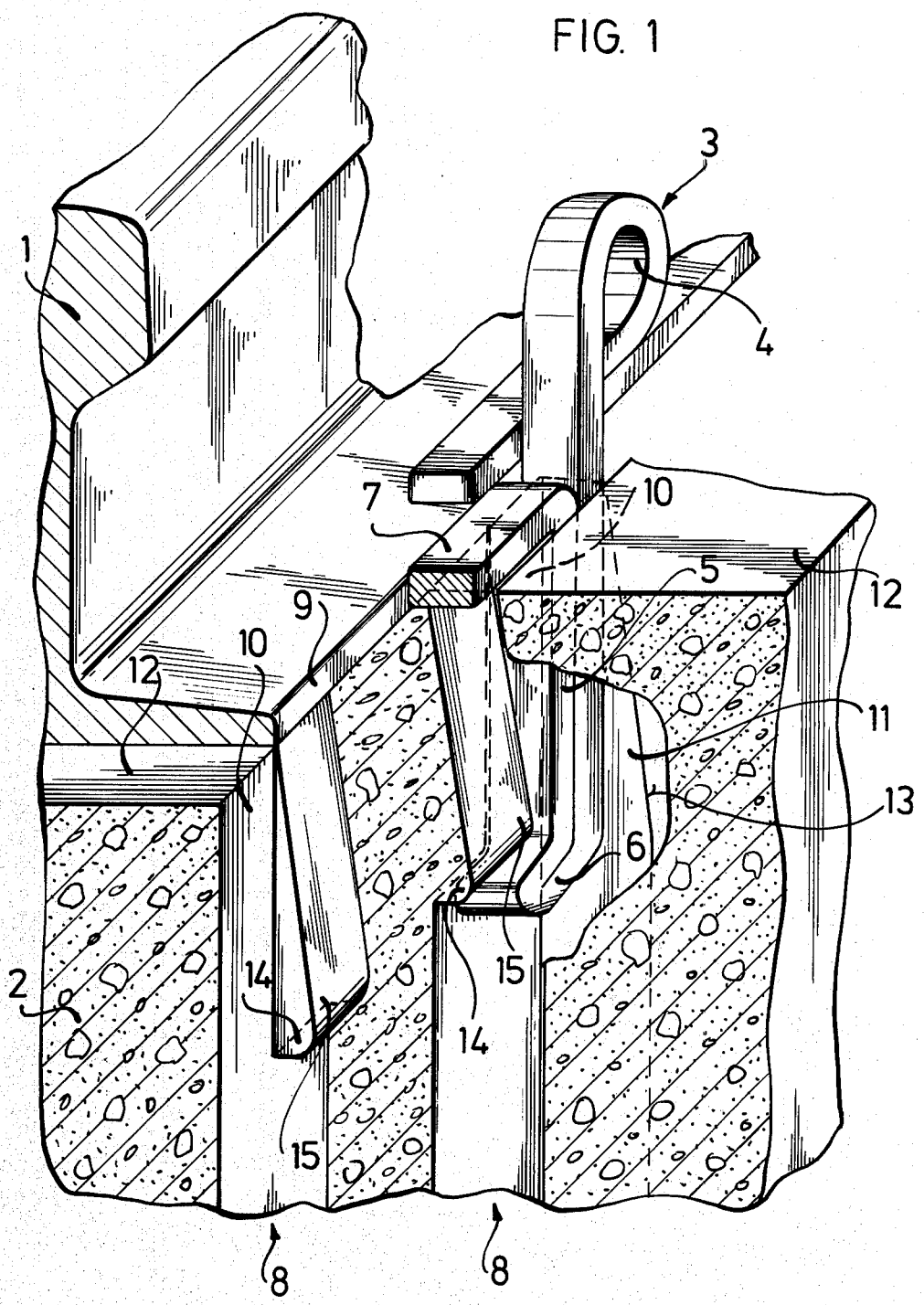
FIG. 1 is a partly sectioned perspective view, showing a mounting system according to the present invention.
Figure 2:
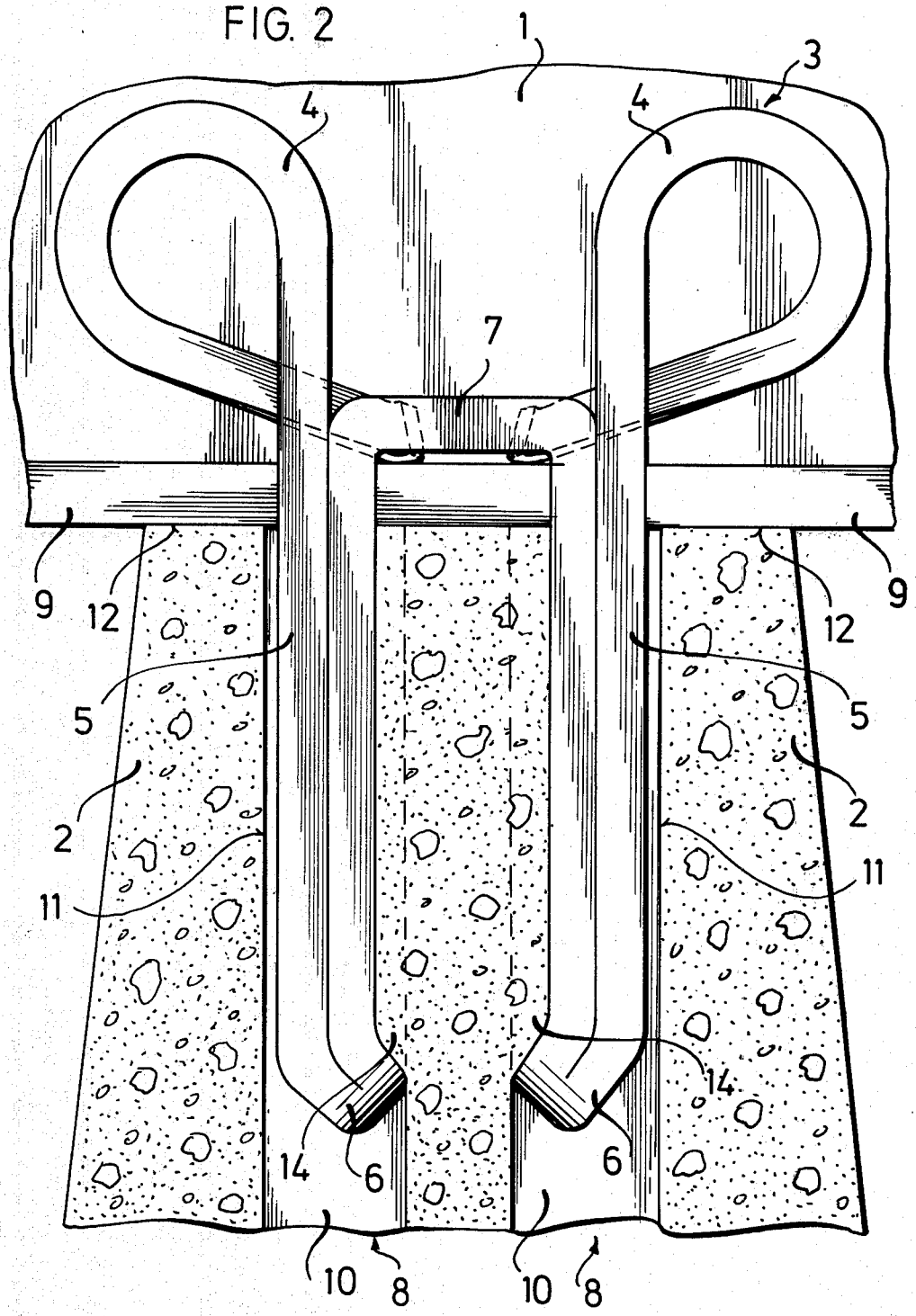
FIG. 2 is a longitudinal section through the mounting system in FIG. 1.

The drawing shows in FIGS. 1–4 that a rail may rest, either directly or by interposition of a not illustrated intermediate plate or the like, on an upper surface 12 of a concrete tie 2. The rail, identified reference numeral 1, is held to the tie 2 by means of a springy rail mounting member 3. This rail mounting member is composed of a springy portion 4 provided at the upper end of a shaft 5, and a claw 6 provided at or near the lower end of the shaft 5. In the particular embodiment illustrated in the drawing the rail mounting member has two of the shafts 5 and two of the claws 6, the shafts 5 being connected by a transverse portion or member 7.

The concrete tie 2 is provided with a recess or passage 8 having an inlet at the upper surface 12 of the tie 2. This inlet has an area or outline corresponding to a vertical projection of the claw 6 onto the surface 12. The inner surface 10 which engages the rail base 9, as well as the thereto adjacent lateral surfaces 11 extend normal to the surface 12, inwardly thereof. The outer surface 13 located opposite or away from the rail base 9 is inclined at a constant angle in outward direction and inwardly away from the surface 12. As a result of this, the cross-section of the passage 8 increases in downward direction. At the inner surface 10 a nose or projection 14 is provided which surrounds the shaft 5 and the claw 6 laterally in contact therewith. The surface 15 of the nose 14 extends parallel to the outer surface 13 of the passage 8 and merges with the inner surface 10 at the upper surface 12 of the rail 2.

Figure 3:
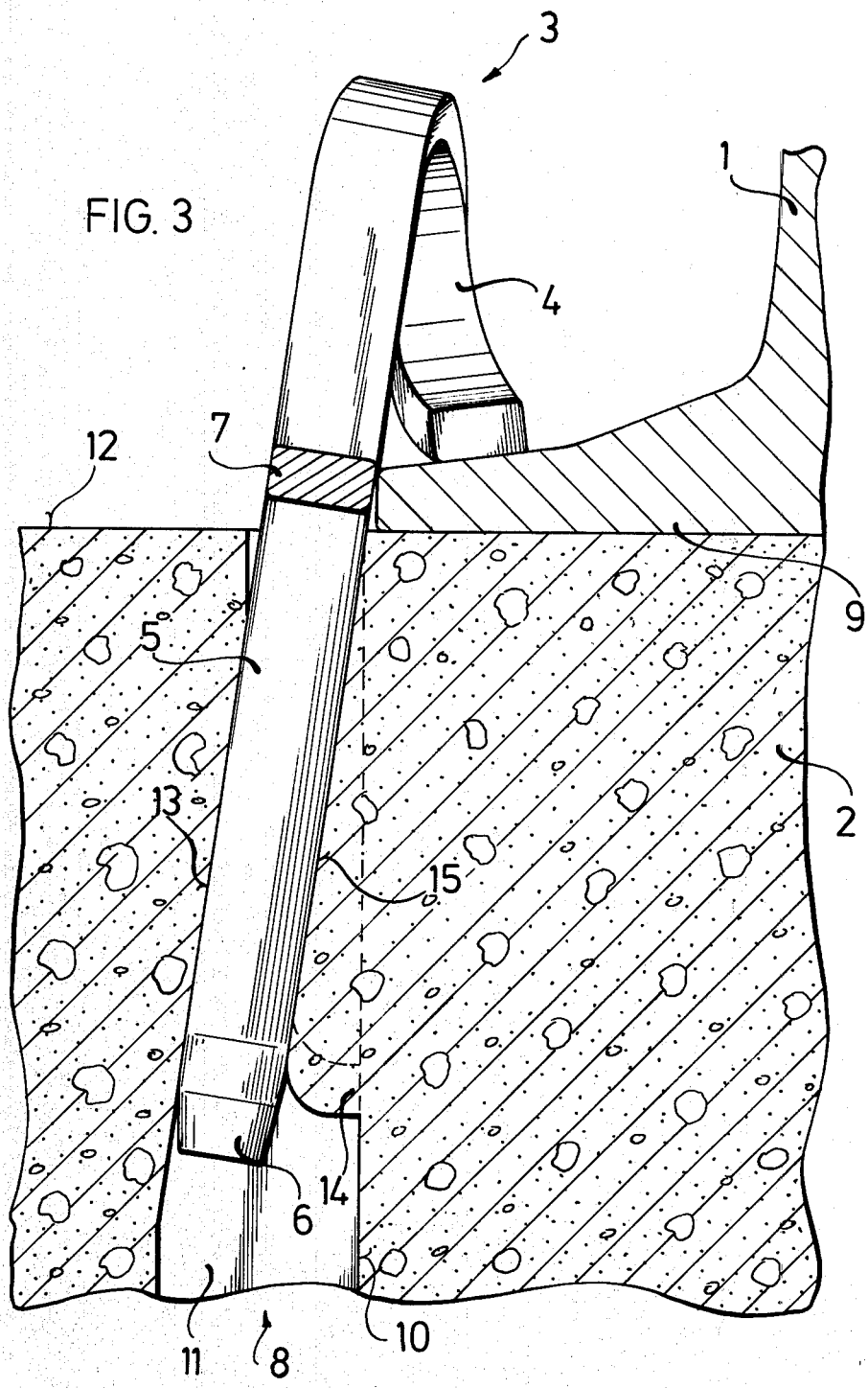
FIG. 3 is a cross-section showing the mounting systems of FIGS. 1 and 2 in mounted position.

To install the rail mounting member 3 the shaft 5 and the claw 6 thereof are inserted inclined outwardly into the passage 8. The claw 6 can pass between the surface 15 and the surface 13 and move past the nose 14, as shown in FIG. 3.

Figure 4:
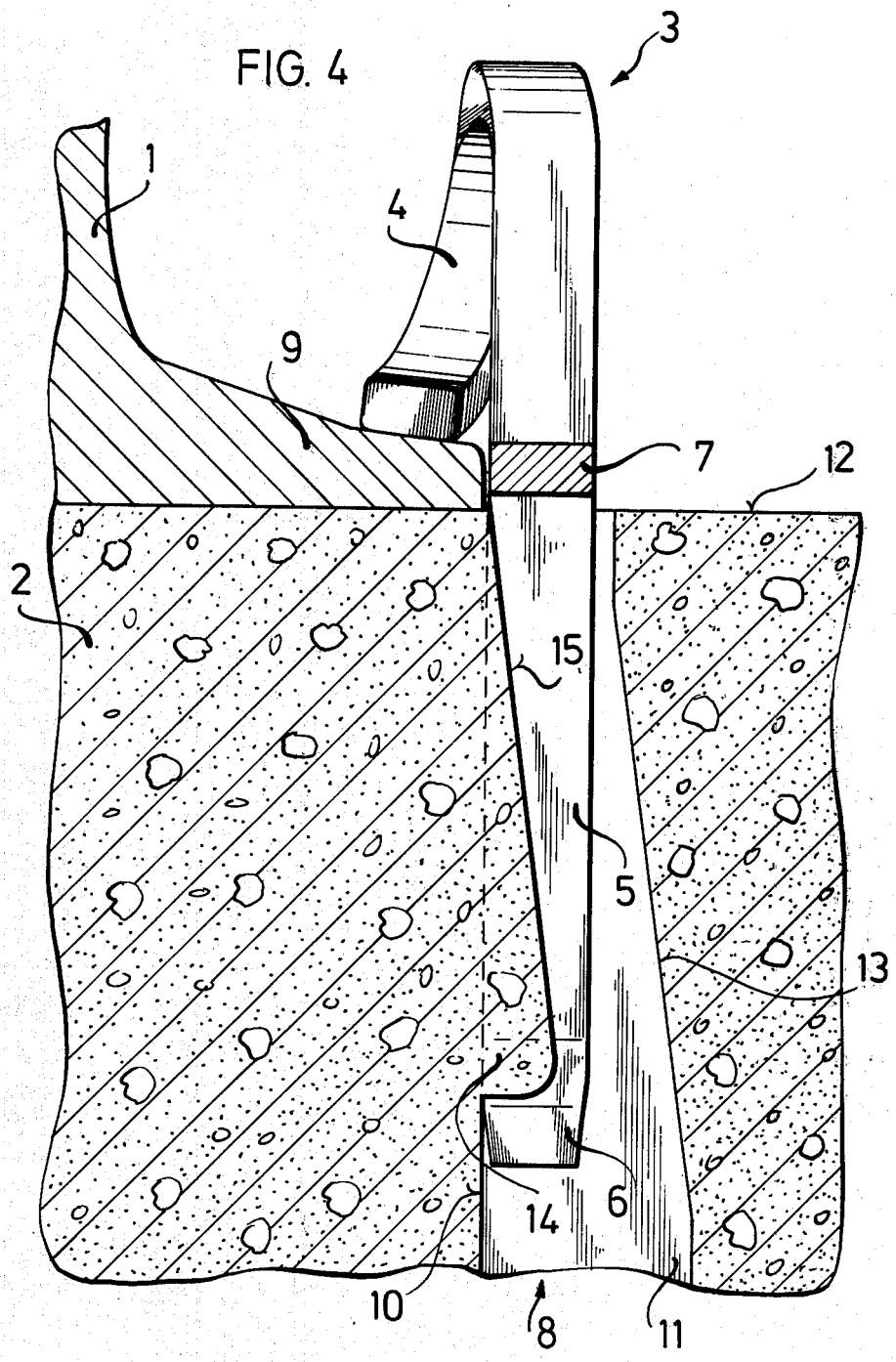
FIG. 4 is a cross-section showing the mounting system of FIGS. 1 and 2 in working position.

When the arrangement reaches the working position shown in FIG. 4, at which the springy portion 4 is compressed and in engagement with the base of the base 9 of the rail 1, the member 3 is moved to vertical position and its claw 9 moves beneath the nose 14. The springy effect of the portion 4 maintains this engagement between claw 6 and nose 14 and in fact facilitates it during the movement of the member 3 to upright position. This assures that the member 3 remains in the proper working position.

If, as is currently preferred, the claw 6 includes with the shaft 5 an angle of between 95° and 140°, the inclination thus obtained in contact with the nose 14 causes the shaft 5 to be urged against the lateral surface 11.

To disengage or dismount the rail mounting member 3, the reverse steps are performed than have been described above. The shaft 5 and the claw 6 must be tilted outwardly against the spring force.

It is advantageous, although not absolutely necessary, if the passage 8 extends all the way through the rail 2, i.e. from the upper to the lower face surface thereof. It is immaterial how the surfaces bounding the passage 8 continue in the area below the working position of the claw 6. However, in order to avoid an unnecessary weakening of the tie 2 it is advantageous if they continue to extend in vertical direction below this position.

The invention has hereinbefore been described with reference to one exemplary embodiment, but it will be understood that various modifications will offer themselves to those skilled in the art and that these are intended to be encompassed within the scope of the appended claims.

I claim:

1. A resilient mounting system for vehicle rails, comprising at least one rail mounting member having an elongated shaft, a resilient rail engaging portion projecting from an upper end of said shaft and a claw projecting to one side of said shaft at a lower end thereof; and at least one concrete tie having an upper surface and an opening extending inwardly thereof, said opening being dimensioned to surround tightly said shaft and claw and having at said surface an inlet of a shape and dimension corresponding to a projection of the claw perpendicular to said shaft, said opening also having a lower end and a cross-section which diverges continuously about the shaft thickness from said inlet towards said lower end in direction transverse to the elongation of said claw, said fastener being removable for replacement of ties, said rails being resiliently connected to said ties.

2. A system as defined in claim 1, wherein said cross-section diverges by a distance equal to a cross-sectional dimension of said shaft.

3. A system as defined in claim 1, said resilient portion being shaped and dimensioned to engage a base of a rail resting on said surface.

4. A system as defined in claim 1, said resilient portion being shaped and dimensioned to engage a base of a rail resting on an intermediate support member which is interposed between the base and said surface.

5. A system as defined in claim 1, wherein said shaft and said claw include with one another an angle of between about 95°–140°.

6. A system as defined in claim 1, said opening being bounded by an inner peripheral surface; and further comprising an abutment projecting from said surface and positioned for said claw to be hooked underneath it.

7. A system as defined in claim 1, said tie having an additional opening similar to the first-mentioned opening and spaced therefrom lengthwise of the rail; and said mounting member including an additional shaft, rail engaging portion and claw and a connecting portion connecting the upper end portions of said shafts, said claws being located in a plane which coincides with longitudinal center lines of the respective shafts.

8. A resilient mounting system for vehicle rails as defined in claim 1, wherein said cross-section diverges by a distance equal to a cross-sectional dimension of said shaft; said resilient portion being shaped and dimensioned to engage a base of a rail resting on an intermediate support member which is interposed between the base and said surface; said shaft and said claw including with one another an angle of between about 95°–140°; said opening being bounded by an inner peripheral surface; and further comprising an abutment projecting from said surface and positioned for said claw to be hooked underneath it; said tie having an additional opening similar to the first-mentioned opening and spaced therefrom lengthwise of the rail; and said mounting member including an additional shaft, rail engaging portion and claw and a connecting portion connecting the upper end portions of said shafts, said claws being located in a plane which coincides with longitudinal center lines of the respective shafts.

* * * * *